US007662053B1

(12) United States Patent
Summers et al.

(10) Patent No.: US 7,662,053 B1
(45) Date of Patent: Feb. 16, 2010

(54) BALL RETURNING BACKSTOP

(75) Inventors: Dustin Summers, 13622 S. Chippewa Tr., Homer Glen, IL (US) 60491; Erik Perez, Round Rock, TX (US); Kenneth G. Heinz, Jr., Batavia, IL (US); John Kaduk, St. Charles, IL (US); Justin Tobin, Aurora, IL (US)

(73) Assignee: Dustin Summers, Homer Glen, IL (US)

( * ) Notice: Subject to any disclaimer, the term of this patent is extended or adjusted under 35 U.S.C. 154(b) by 126 days.

(21) Appl. No.: 11/959,168

(22) Filed: Dec. 18, 2007

Related U.S. Application Data

(60) Provisional application No. 60/870,546, filed on Dec. 18, 2006.

(51) Int. Cl.
*A63B 69/00* (2006.01)

(52) U.S. Cl. ..... 473/431; 473/451; 473/454

(58) Field of Classification Search ..... 473/431, 473/432, 422, 454–456, 451; 273/407, 410; 124/6, 7, 16, 56, 64, 78, 79
See application file for complete search history.

(56) References Cited

U.S. PATENT DOCUMENTS

| | | | | | |
|---|---|---|---|---|---|
| 2,657,058 | A | * | 10/1953 | Mulcahy | 473/436 |
| 4,070,017 | A | | 1/1978 | Lombardi | |
| 4,118,028 | A | | 10/1978 | Larkin | |
| 4,275,883 | A | | 6/1981 | Grimaldi et al. | |
| 4,643,423 | A | | 2/1987 | Wright | |
| 4,657,250 | A | * | 4/1987 | Newland et al. | 473/432 |
| 4,883,272 | A | | 11/1989 | Lay | |
| 4,913,427 | A | | 4/1990 | Wilson | |
| 4,978,121 | A | * | 12/1990 | Larkey | 473/454 |
| 5,064,194 | A | | 11/1991 | Bixler et al. | |
| 5,133,548 | A | | 7/1992 | Bedord et al. | |
| 5,363,736 | A | | 11/1994 | Huang | |
| 5,419,549 | A | | 5/1995 | Galloway et al. | |
| 5,519,957 | A | | 5/1996 | Iannetta | |
| 5,566,934 | A | | 10/1996 | Black | |
| 5,573,239 | A | | 11/1996 | Ryker et al. | |
| 5,581,046 | A | | 12/1996 | Weldle et al. | |
| 5,588,645 | A | | 12/1996 | Schwan et al. | |
| 5,599,017 | A | | 2/1997 | Bixler et al. | |
| 6,155,936 | A | | 12/2000 | Dorr | |
| 6,189,889 | B1 | | 2/2001 | Yip | |
| 6,379,272 | B1 | * | 4/2002 | Gorgo et al. | 473/421 |
| 6,517,452 | B2 | | 2/2003 | Endres | |
| 6,620,064 | B2 | * | 9/2003 | Nickerson | 473/431 |
| 7,066,845 | B2 | * | 6/2006 | Joseph | 473/431 |
| 7,137,910 | B2 | * | 11/2006 | Ktson et al. | 473/431 |
| 7,156,761 | B2 | * | 1/2007 | Mesa | 473/451 |

* cited by examiner

*Primary Examiner*—Mitra Aryanpour
(74) *Attorney, Agent, or Firm*—Hovey Williams LLP

(57) ABSTRACT

A ball returning backstop assembly includes a backstop that collects a thrown ball and a ball return assembly that returns the collected ball. The ball return assembly includes a housing that supports a linkage for propelling the collected ball and a motor for driving the linkage. The housing includes a tube that receives the collected ball, with the linkage having a piston that is slidable within the tube to propel the ball out of the tube. The motor is electrically connected to switches that control when the motor drives the linkage. One switch being configured to turn the motor on when the collected ball is ready to be returned and the other switch being configured to turn the motor off after the ball is propelled out of the tube.

17 Claims, 8 Drawing Sheets

BALL RETURNING BACKSTOP

RELATED APPLICATION

This application claims the benefit of U.S. Provisional Application Ser. No. 60/870,546, filed Dec. 18, 2006, which is hereby incorporated in its entirety by reference herein.

BACKGROUND

1. Field

The present invention relates generally to sports training devices. More specifically, embodiments of the present invention concern a ball returning backstop configured to collect and return a ball thrown by a user.

2. Discussion of Prior Art

For sports that involve throwing, catching, or hitting of balls, such as baseball, various training aids are available to help athletes improve their throwing, catching, or hitting technique. For example, backstops are commonly used by baseball players to practice throwing a baseball when another person is not available to catch the thrown ball. Mechanical devices for throwing balls, such as a baseball pitching machine, are also conventional. Furthermore, it is known to combine a backstop with a machine that throws a ball so that the combination can collect a thrown ball and return the ball to the user.

Prior art backstops and ball return machines are problematic and suffer from various undesirable limitations. For instance, prior art ball return machines are too expensive for most consumers. Prior art ball return machines are also too complex to operate and often require a user to manually place the ball in the machine before it is propelled out of the machine. Prior art backstops that deflect the thrown ball are deficient because they deflect the ball inconsistently and without sufficient distance to return the ball to the user.

SUMMARY

The present invention provides a ball returning backstop that does not suffer from the problems and limitations of the prior art backstops and ball return machines set forth above.

One aspect of the present invention concerns a ball returning backstop assembly configured to collect and return a ball thrown by a user. The ball returning backstop assembly broadly includes a backstop and a ball return assembly. The backstop is configured to collect the thrown ball. The ball return assembly is operably coupled to the backstop to receive the collected ball from the backstop and then return the ball. The ball return assembly includes a housing, a rotatable motor, and a linkage assembly. The housing presents a ball guiding surface configured to receive the thrown ball after being collected by the backstop. The ball guiding surface presents a ball returning path with an axis that extends from a rearward end of the path to a forward end of the path, with the surface being configured to guide the ball along the axis as the ball is being propelled toward the forward end. The linkage assembly is drivingly coupled to the motor and includes a link shiftably mounted relative to the housing. The link is shiftable to reciprocate between a rear position adjacent the rearward end and a forward position spaced forwardly of the rear position. The link has a ball-engaging end that is operably coupled to the housing to follow the axis, with the ball-engaging end being configured to engage the ball and propel the ball along the axis. The housing presents between the path ends an opening that communicates the ball returning path with the backstop, with the linkage assembly being configured to position the ball received from the backstop through the opening forwardly of the ball-engaging end.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
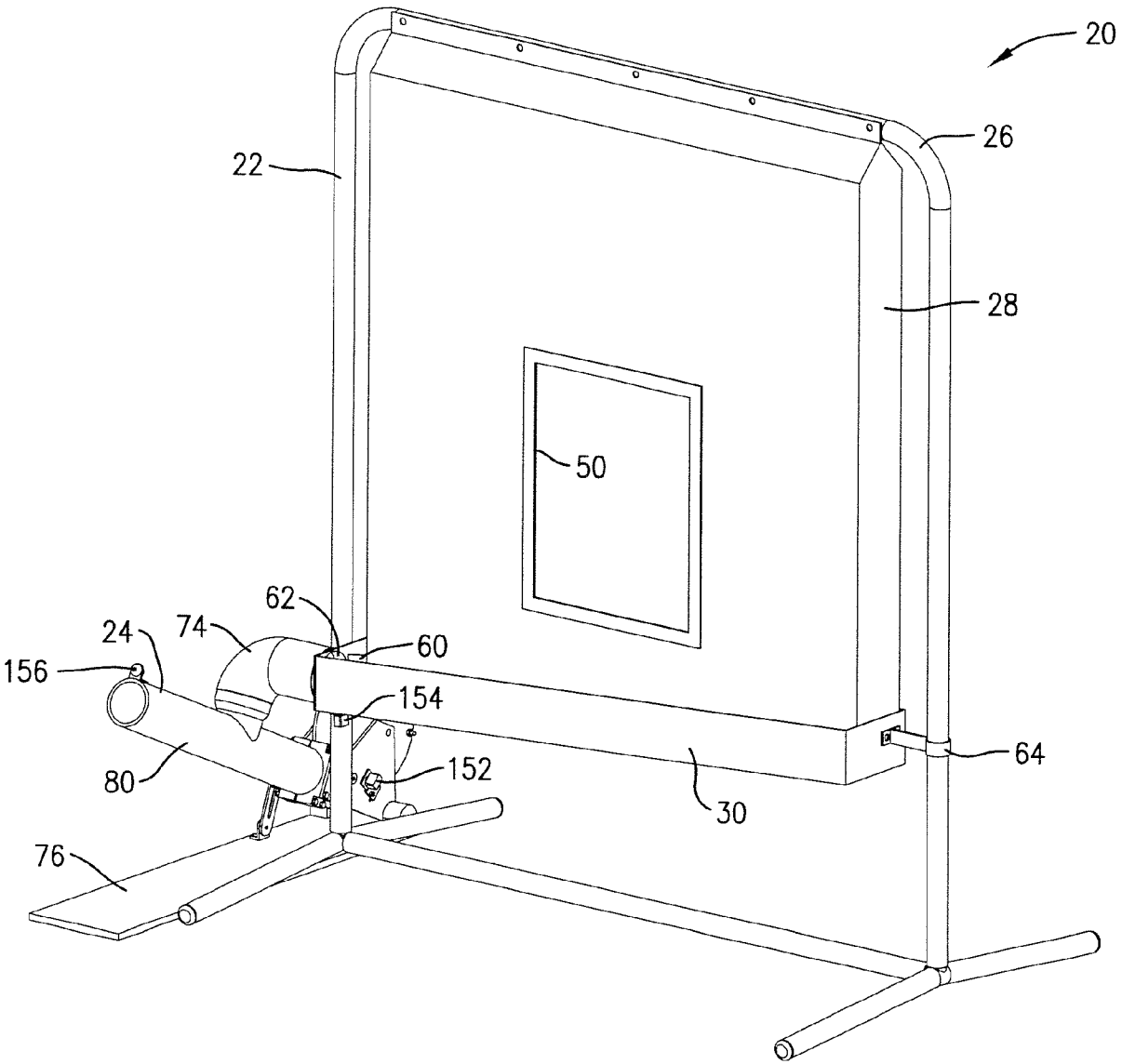
FIG. 1 is a right side perspective view of a ball returning backstop assembly constructed in accordance with a preferred embodiment of the present invention.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 7:
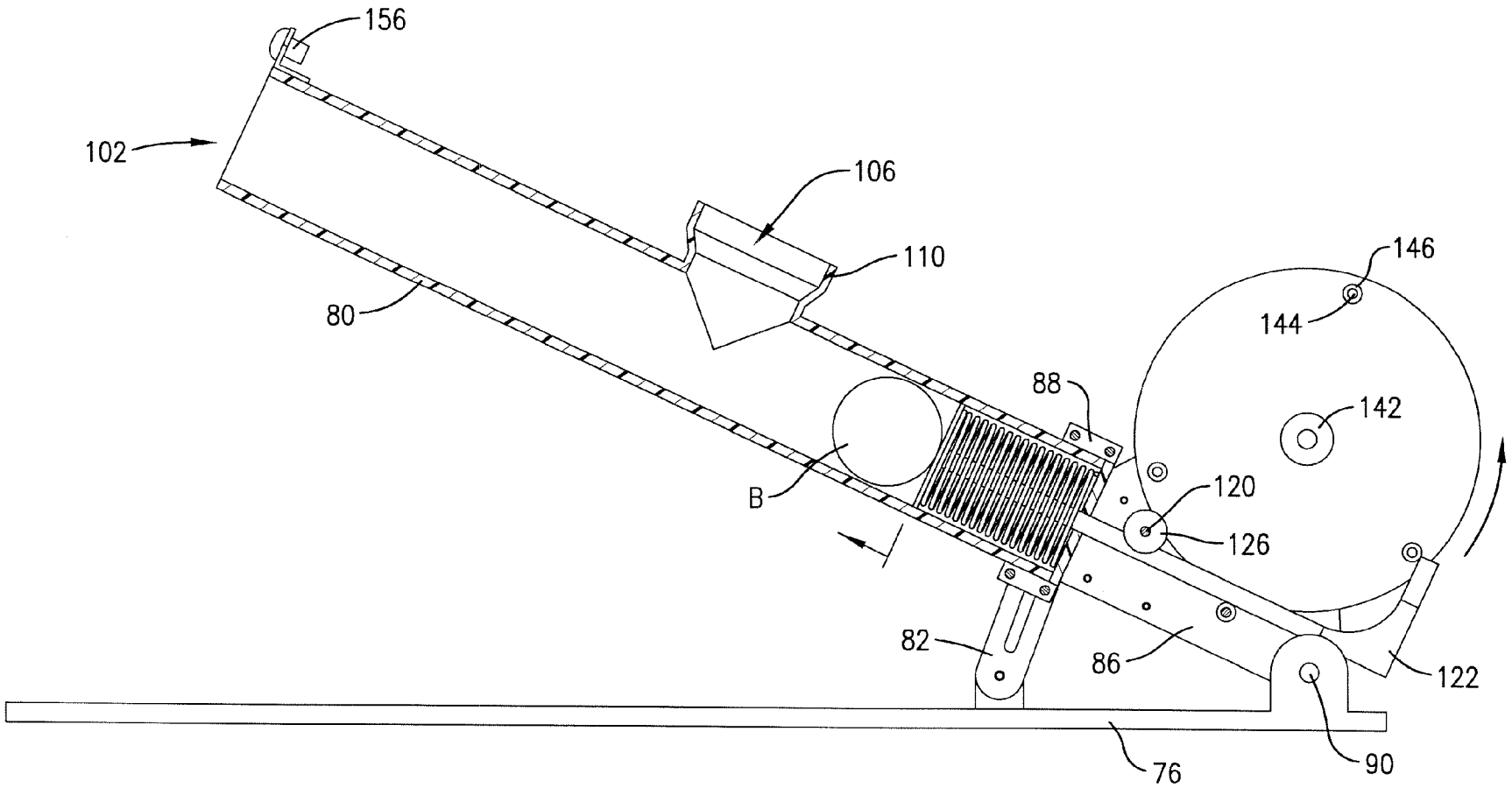
FIG. 7 is a cross-sectional view of the ball return assembly shown in FIG. 6, showing the linkage assembly shifted so that the piston is in a rearward position.

Turning initially to FIGS. 1 and 7, a ball returning backstop assembly 20 serves as a training device that permits a user (not shown) to practice throwing a ball B without having another person catch and return the thrown ball B. As will be discussed, the illustrated backstop assembly 20 is particularly configured for catching and returning a baseball. But the backstop assembly 20 could be sized and configured for use with balls used in other sports, e.g., lacrosse, soccer, or tennis, without departing from the scope of the present invention. Also, while the backstop assembly 20 is operable to collect and return a ball B that is pitched to the backstop assembly 20, it is also within the scope of the present invention where the ball B can be otherwise thrown, kicked, or hit into the backstop assembly 20. The backstop assembly 20 is also operable to help the user practice catching the ball B or hitting the ball B. The backstop assembly 20 broadly includes a backstop 22 and a ball return assembly 24.

Figure 2:
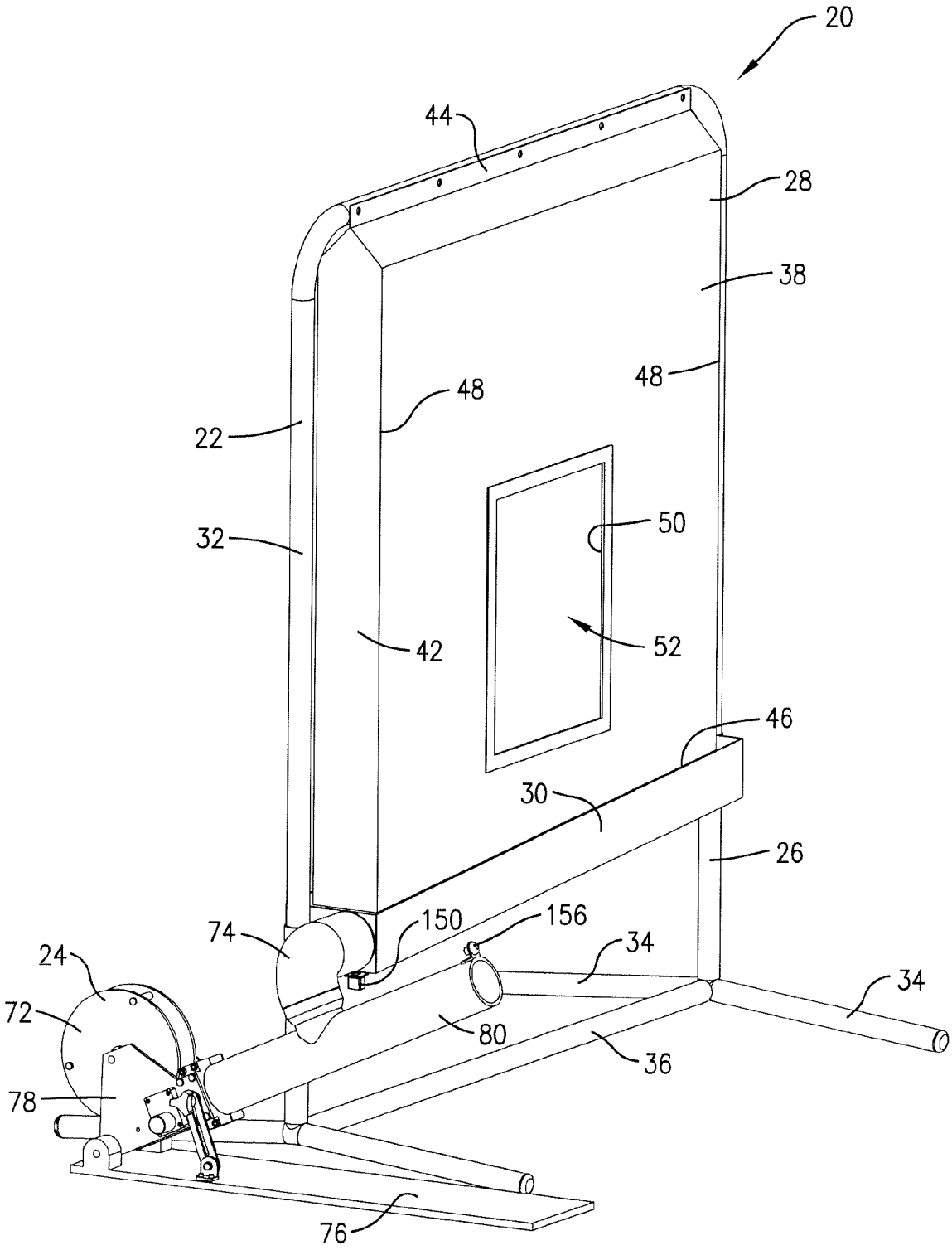
FIG. 2 is a left side perspective view of the ball returning backstop assembly shown in FIG. 1.
Figure 3:
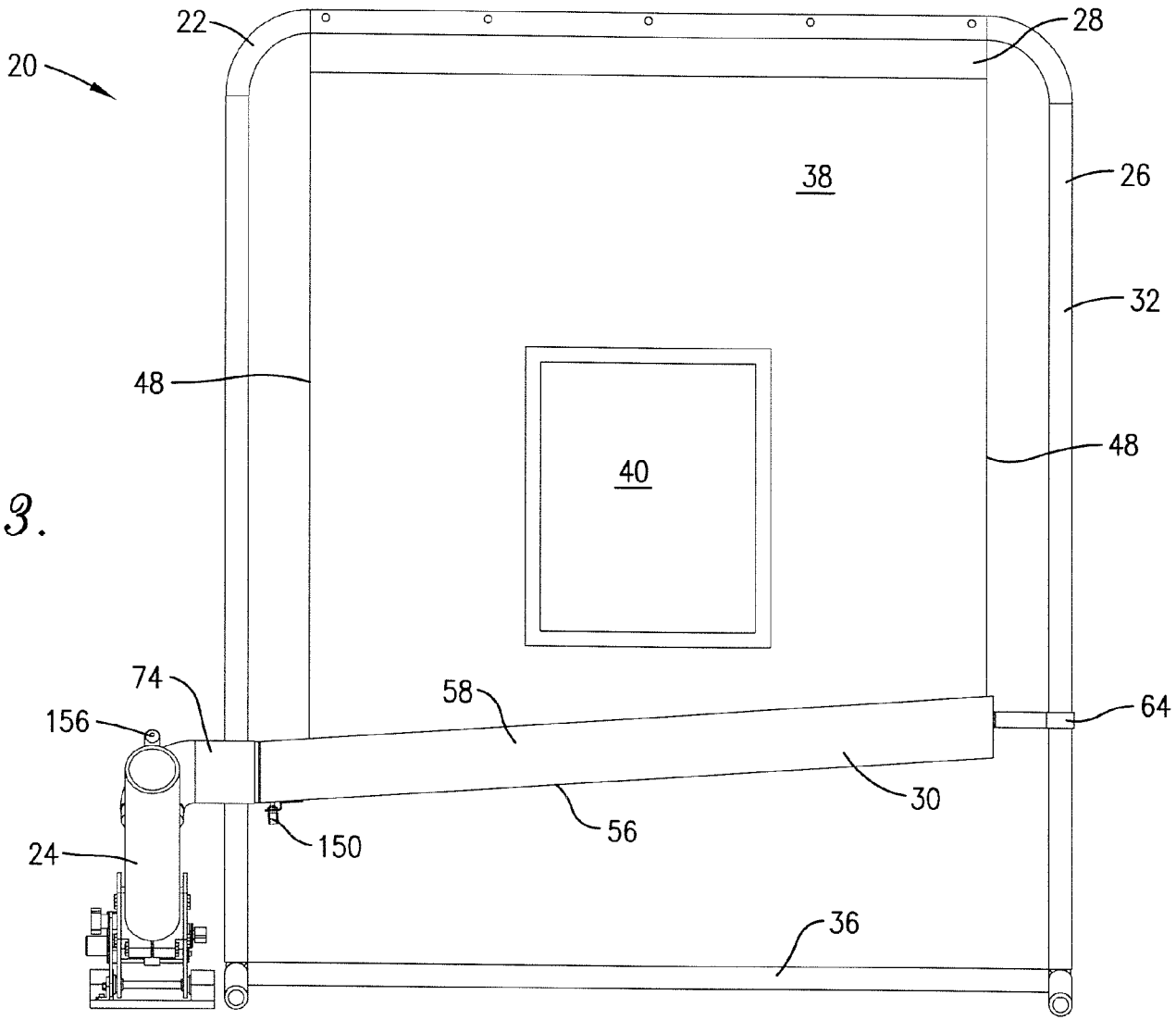
FIG. 3 is a front elevation view of the ball returning backstop assembly shown in FIGS. 1 and 2.
Figure 4:
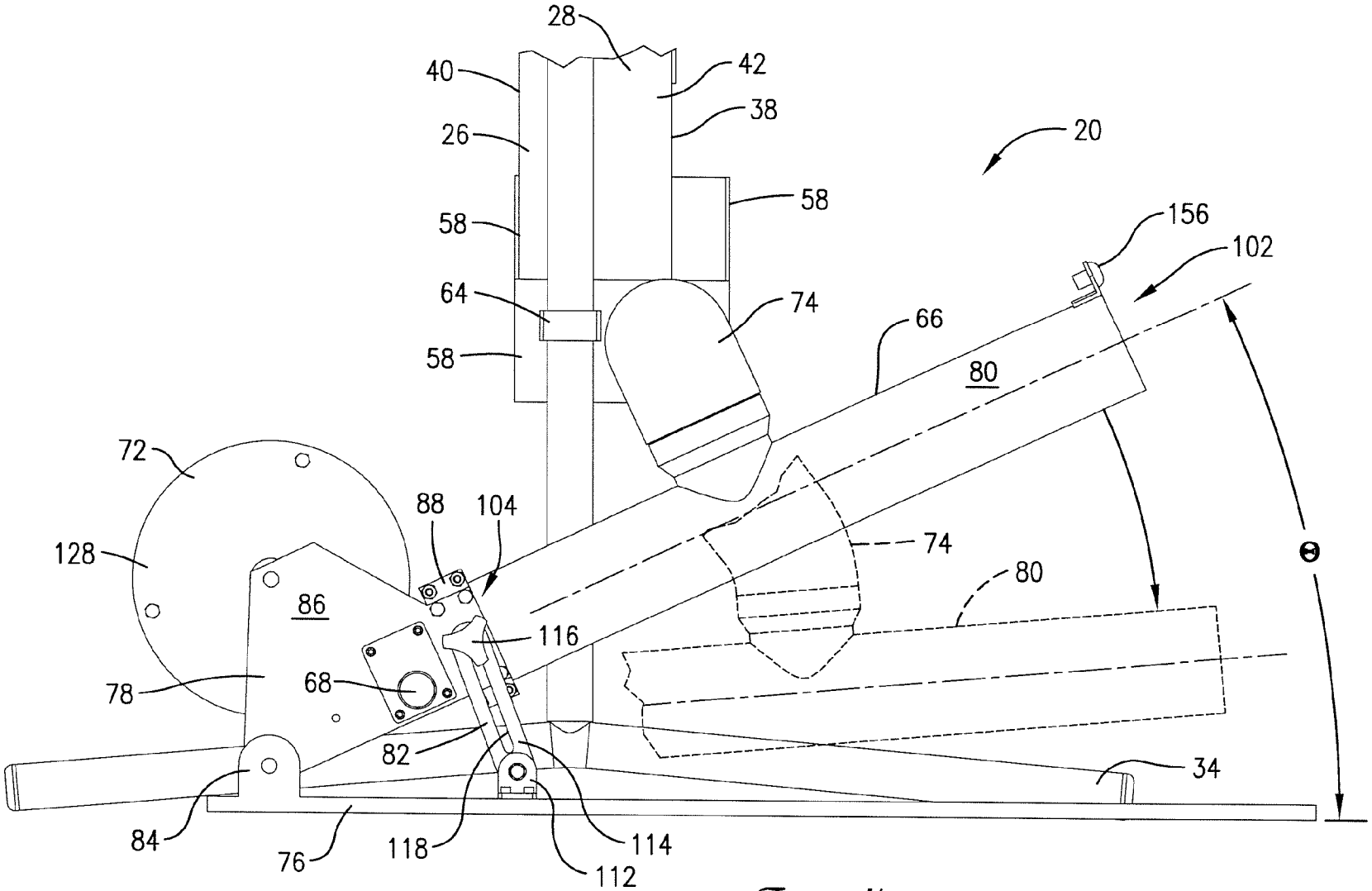
FIG. 4 is an enlarged fragmentary left side elevation view of the ball returning backstop assembly shown in FIGS. 1-3, showing a ball return assembly that is adjustable relative to a backstop to provide a ball return launch angle.
Figure 5:
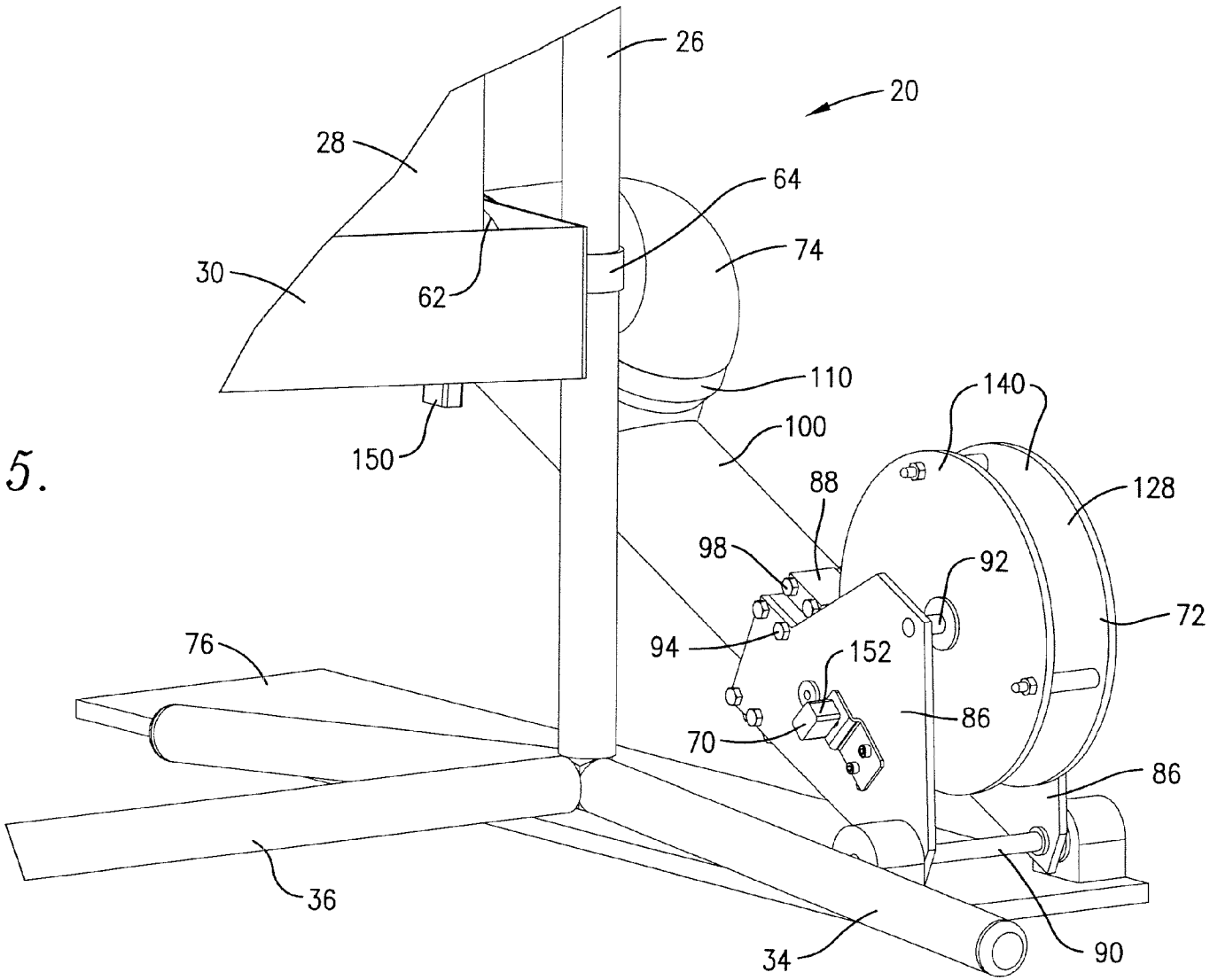
FIG. 5 is a rear fragmentary perspective view of the ball returning backstop assembly shown in FIGS. 1-4, showing switches attached to the ball return assembly and the backstop that are configured to control the ball return assembly.

Turning to FIGS. 1-3, the backstop 22 is operable to collect the thrown ball B and feed the ball B to the ball return assembly 24 as will be discussed in greater detail. The backstop 22 includes, among other things, a frame 26, a partition assembly 28, and a trough 30. The frame 26 is formed of tubing and includes an upright portion 32, legs 34 attached to respective ends of the upright portion 32, and a cross member 36 attached to the respective ends of the upright portion 32.

The partition assembly 28 includes front and back partitions 38,40 and side partitions 42. The front and back partitions 38,40 each present upper and lower edges 44,46 and side edges 48. The front partition 38 also presents a rectangular opening 50 spaced inwardly from the respective edges 44,46, 48. The front and back partitions 38,40 are attached together along their upper edges 44 and are joined along respective side edges 48 by attaching the corresponding side partition 42 between the respective side edges 48. The partition assembly 28 presents an enclosed volume 52 and a lowermost opening formed by the lower edges 46. The partition assembly 28 is attached to the frame 26 by securing the upper edges 44 to a lateral segment of the upright frame portion 32. The illustrated partitions 38,40,42 are preferably made from a synthetic fabric that is flexible, such as a canvas material, but the principles of the present invention are applicable where the partitions 38,40,42 include other materials.

The illustrated partition assembly 28 preferably serves to identify the general location and size of a typical strike zone as used in baseball. But the principles of the present invention are also applicable where the partition assembly 28 includes other features or structure. For instance, the partition assembly 28 could identify particular areas within a strike zone, e.g., by including circular cutouts in the front partition 38 instead of the rectangular opening 50. The partition assembly 28 could also include another partition element spaced between the front and back partitions 38,40 that presents such cutouts and with the front partition 28 also presenting the opening 50. In this manner, ball B could be pitched through the opening 50 and either pass through one of the cutouts or hit the partition element, with the user receiving visual feedback of whether the pitch entered the intended area of the strike zone.

Turning to FIGS. 1-5, the trough 30 includes a bottom wall 56 and upright sidewalls 58 that define a trough cavity. The trough 30 also includes a deflector wall 60 and presents a side opening 62 adjacent the deflector wall 60, with the wall 60 being operable to deflect the ball B toward the side opening 62. The trough 30 is attached to the frame 26 with brackets 64 on opposite ends of the trough 30. The lower edges 46 are received within the trough cavity so that the enclosed volume 52 communicates with the trough cavity. In this manner, the ball B can be pitched through the opening 50, with the ball B being operable to fall into the trough 30. Also, the trough 30 is positioned with the bottom wall 56 sloping downwardly toward the side opening 62. Thus, the trough 30 is operable to encourage the ball B by gravity to roll towards the side opening 62 and out of the trough 30. The illustrated trough 30 is preferably formed of plastic and then attached relative to the partition assembly 28. However, the trough 30 could be alternatively constructed. For instance, the lower edges 46 could be folded up and sewn to the front partition 38 to create an exterior pocket that serves as a trough, with holes being cut through the front partition 38 so that ball B could pass from the enclosed volume 52 to the pocket.

While the illustrated backstop 22 is operable to catch and collect the ball B only if it is thrown through the opening 50, the principles of the present invention are applicable where the trough 30 can collect the ball B if it is thrown outside of the opening 50. For instance, the trough 30 could project a substantial distance (e.g., at least one diameter of the ball B) in front of the entire front partition 38 to catch the ball B if it hits the front partition 38 and does not pass through the opening 50. In this manner, the user would receive a visual cue that the ball B missed the strike zone, but the backstop 22 would still be operable to collect the ball B.

Turning to FIGS. 4-8 the ball return assembly 24 is operable for returning the ball B that is received from backstop 22, as will be discussed in greater detail. The ball return assembly 24 broadly includes a housing 66, a motor 68, a switch assembly 70, a linkage assembly 72, and a duct 74.

The housing 66 includes a base 76, a linkage frame 78, a tube 80, and a pivot brace 82. The base 76 preferably includes a substantially flat body and tabs 84 attached to an end of the body that cooperate with the linkage frame 78 to form a pivotal hinge as will be discussed further. It is also within the scope of the present invention where the base 76 is alternatively configured. For example, the base 76 could comprise a tripod-shaped base for use on uneven terrain and for permitting a greater range of pivotal movement between the base 76 and the rest of the ball return assembly 24. Also, the base 76 could include a cover that encloses at least part of the ball return assembly 24 to restrict the ball return assembly 24 from being damaged or tampered with, e.g., where the ball B is thrown by the user and strikes the ball return assembly 24.

The linkage frame 78 is operable to support the linkage assembly 72 and includes a pair of support plates 86, tube clamps 88, pivot pin 90, and disc pin 92. The support plates 86 are both substantially unitary and are similarly shaped. Both present holes for receiving the respective pins 90,92 and for receiving fasteners 94 that attach the tube clamps 88 to respective ones of the support plates 86. The support plates 86 are attached to each other by extending the pins 90,92 into the corresponding holes. The pivot pin 90 is also secured within holes presented by the tabs 84 so that the tabs 84, support plates 86, and pivot pin 90 cooperatively form a hinged joint. In this manner, the hinge permits the linkage frame 78 to pivot relative to base 76.

The tube clamps 88 are substantially similar and serve to cooperatively secure the tube 80 onto the linkage frame 78. The tube clamps 88 present an inner annular surface 96 that conforms to the tube 80. The tube clamps 88 also present threaded holes that receive the fasteners 94 and holes that receive fasteners 98 for securing the tube clamps 88 to each other.

The tube 80 is operable to receive and guide ball B as will be discussed in greater detail. The tube 80 includes a tubular body 100 that presents forward and rearward ends 102,104 and a side opening 106. The tube 80 further includes an end plate 108 that partly encloses the rearward end 104 and a stub tube 110 attached to the body 100 and surrounding the side opening 106. The tube 80 presents an internal path with an axis and forward and rearward ends adjacent the respective ends 102,104. The tubular body 100 is preferably elongated and cylindrical with a substantially linear longitudinal axis. But the principles of the present invention are applicable where the body 100 is alternatively configured. For instance, a portion of the body 100 could present an arcuately shaped axis adjacent the forward end 102 for providing a ball trajectory in an alternative direction. The body 100 could include multiple sections for selectively changing the ball trajectory, e.g., multiple end-most sections having different shapes could be selectively installed on a remainder of the body 100 to provide the desired trajectory. It is also within the scope of the present invention where the body 100 is formed from structure other than an enclosed tubular structure, but is still constructed to support and guide the ball B. For instance, the body 100 could be made from an open channel with one or more openings that extend along the longitudinal axis.

The tube 80 is secured to the linkage frame 78 by positioning the rearward end 104 between the tube clamps 88 and tightening the fasteners 98 until the tube clamps 88 securely grab the tube 80. The secured tube 80 is positioned so that the side opening 106 opens in an upright direction for receiving ball B as will be discussed.

The pivot brace 82 is configured to secure the linkage frame 78 and the tube 80 relative to the base 76 at a predetermined launch angle θ measured between the tube 80 and a ground-engaging surface of the base 76. The pivot brace 82 includes a bracket 112, a slotted member 114, and an adjustment screw 116. The slotted member 114 is unitary and presents an elongated slot 118 and a hole adjacent to an end of the slot 118. The bracket 112 is fastened to the base 76 and is pivotally attached to the slotted member 114 by a pin that extends through the bracket 112 and the hole in the slotted member 114. The adjustment screw 116 is slidably received by the slot 118 and is threaded into the support plate 86. Thus, the adjustment screw 116 permits the slotted member 114 to slide relative to the linkage frame 78 and is configured to set the ball return assembly 24 at the desired launch angle θ and thereby selectively restrict movement of the slotted member 114 relative to the linkage frame 78. Preferably, the illustrated pivot brace 82 permits the launch angle θ to be set in the range of about zero (0) degrees to about thirty (30) degrees. More preferably, the pivot brace 82 permits the launch angle θ to be set at about twenty-five (25) degrees. It has been determined that this range of launch angle provides a preferred ball trajectory for certain applications. But the principles of the present invention are equally applicable where the launch angle θ is set at another angle. For instance, the launch angle θ could be greater than thirty degrees for certain applications, e.g., for a baseball player that wants to practice catching fly balls. Also, the launch angle θ could be less than zero degrees for certain applications, e.g., for the baseball player that wants to practice fielding ground balls. As the launch angle θ is changed, the side opening 106 remains operable to permit the ball B to pass into the tube 80.

The duct 74 is configured to operably interconnect the trough 30 and the tube 80 so that the ball B can pass from the trough 30 to the tube 80. The duct 74 preferably comprises a flexible duct material that permits relative movement between the tube 80 and the trough 30. In particular, the duct 74 permits the launch angle θ to be shifted while maintaining the connection between the trough 30 and the tube 80. The duct 74 presents opposite ends, with one end being attached to the stub tube 110 and the other end being attached to the trough 30 at the side opening 62. While the illustrated duct 74 is preferably unitary, the principles of the present invention are applicable where duct 74 includes multiple duct elements. Furthermore, some duct elements could comprise rigid materials. The illustrated duct 74 is preferred for operably connecting the trough 30 and tube 80. However, it is within the ambit of the present invention to connect the trough 30 and tube 80 in another manner so that the ball B can pass therebetween. For example, the trough 30 could include a spout configured to drop the ball B into a container of the ball return assembly 24. The container could be, for instance, a funnel that leads into the side opening 62. Thus, the trough 30 could pass the ball B to the tube 80 without being physically attached to the tube 80. While the ball B is preferably shifted by gravity into the tube 80, it is also within the scope of the present invention to use a powered mechanism to load the ball B into the tube 80.

The motor 68 is operable to power the ball return assembly 24 as will be discussed further. The motor 68 includes a motor body and a motor shaft 120. The motor 68 is attached to the support plate 86 by fasteners, with the motor shaft 120 extending through a hole in the support plate 86. The illustrated motor 68 is preferably a gear motor that operates with an output shaft speed of about 35 revolutions per minute (RPM), with a maximum torque of about 38 inch-pounds, and which is powered by 24 volts DC. But the principles of the present invention are also applicable where the motor 68 has different operating characteristics. For example, the motor 68 could provide greater torque or operating speed to meet the desired operating requirements for the ball return assembly 24. The illustrated motor 68 is supplied by Burden Sales Company and designated 35 RPM 24 VDC MOLON GEARMOTOR, Part No. 5-1257.

Figure 6:
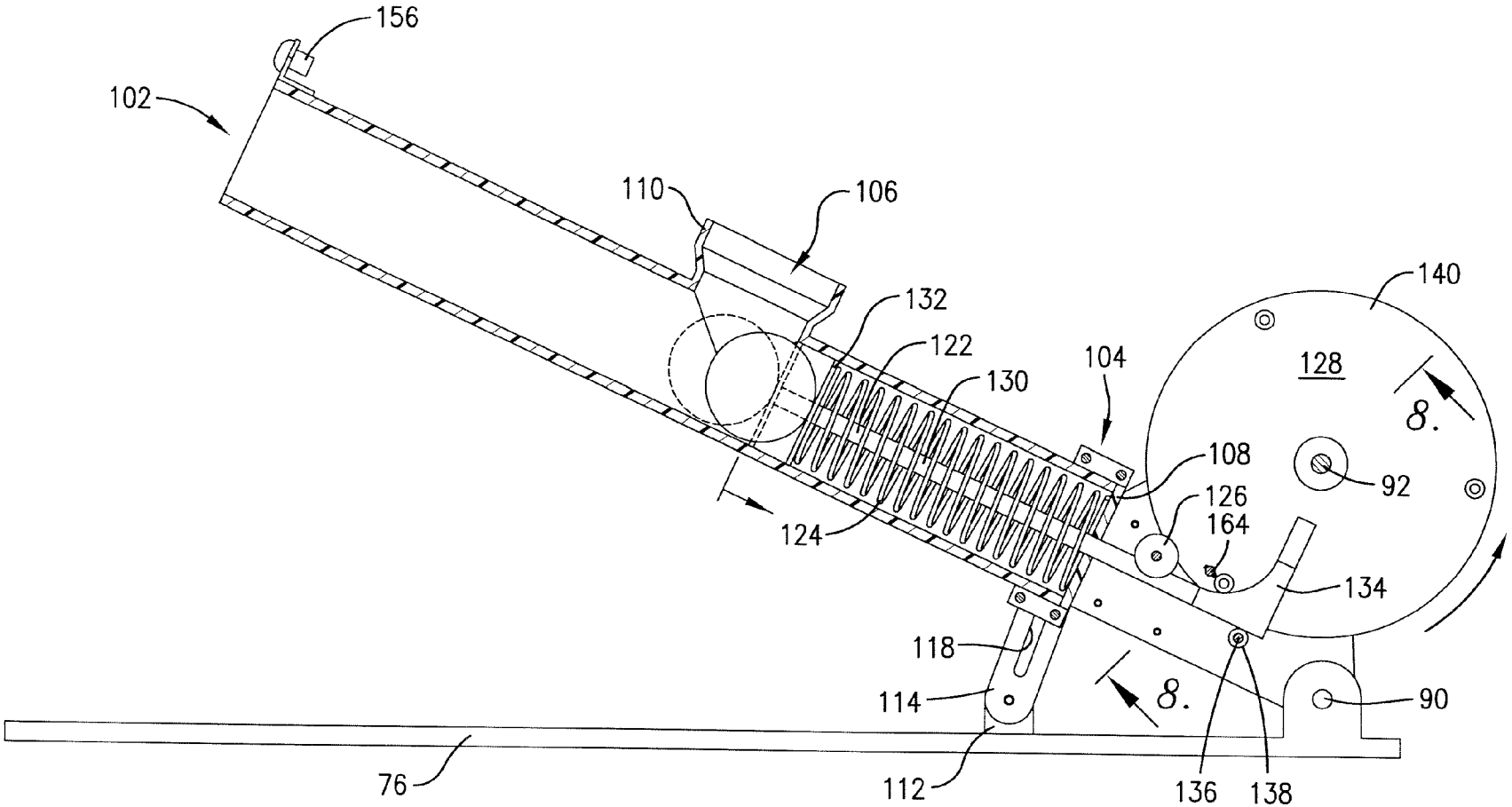
FIG. 6 is a cross-sectional view of the ball return assembly shown in FIGS. 1-5, showing a linkage assembly including a piston in a forward position, and also showing the linkage assembly engaging the piston, with the piston being spaced just behind the forward position.

The linkage assembly 72 is operably mounted to the housing 66 for propelling the ball B out of the tube 80. The linkage assembly 72 includes a piston 122, a spring 124, drive wheels 126, and a driven wheel 128. The piston 122 includes a longitudinal rod 130 made from tubing and presenting opposite ends. The piston 122 further includes a circular plate 132 attached to one end of the rod 130 and a catch arm 134 attached to the other end of the rod 130. The piston 122 is slidably mounted within the tube 80, with the rod 130 extending through an opening in the end plate 108. The piston 122 is operable to linearly reciprocate along an axis of the tube 80 between a forward position (see FIG. 6, showing the piston 122 in broken lines) and a rearward position (see FIG. 7). The piston 122 is also operable to be powered by the motor 68 as will be discussed further. While the illustrated piston 122 is preferred for propelling the ball B, it is within the scope of the present invention to use an alternative mechanism For instance, the circular plate 132 could be drivingly attached to a pivotal link.

The spring 124 is preferably a conventional coiled spring with a spring constant of about 32 pounds/inch. The spring 124 is received within the tube 80, with the rod 130 extending through the spring 124. The spring 124 is also positioned between the end plate 108 and the circular plate 132. With the piston 122 in the forward position, the spring 124 is substantially unsprung. As the piston 122 is shifted into the rearward position, the plates 108,132 compress the spring 124 so that the spring 124 urges the piston 122 forward. A support pin 136 is attached to the support plates 86, with a spacer 138 rotatably mounted on the support pin 136. The spacer 138 is operable to engage a lower edge of the rod 130 as the piston 122 shifts in and out of the tube 80. The spring 124 is preferably configured to be compressed from an unsprung length to a compressed length a distance of about four (4) inches. But the spring 124 could have different spring characteristics without departing from the scope of the present invention. Furthermore, a spring other than a coiled spring could be used without departing from the scope of the present invention. While the spring constant is preferably non-variable through the spring's range of compression, the principles of the present invention are applicable where the spring constant is adjustable, e.g., a variable rate spring, or where the spring 124 can be replaced by a spring with a different spring constant.

Figure 8:
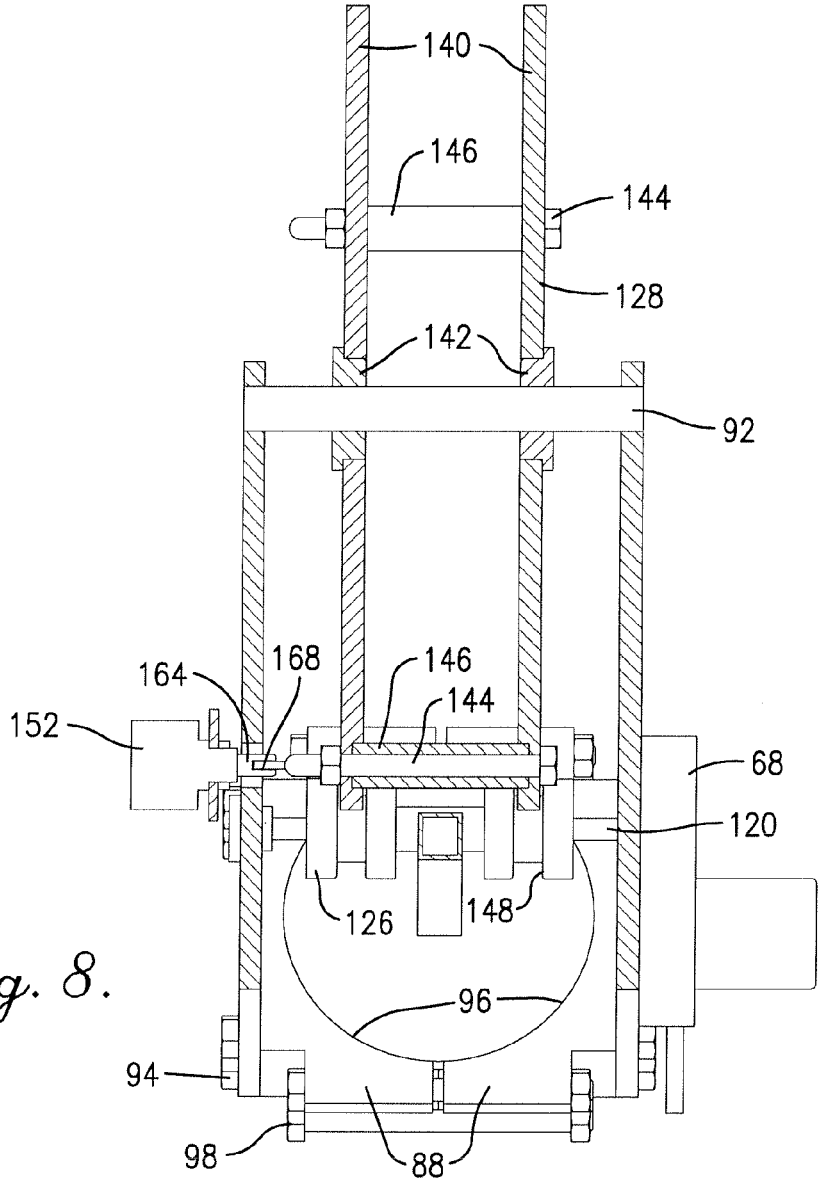
FIG. 8 is a cross-sectional view of the ball return assembly taken along line 8-8 in FIG. 6.
Figure 9:
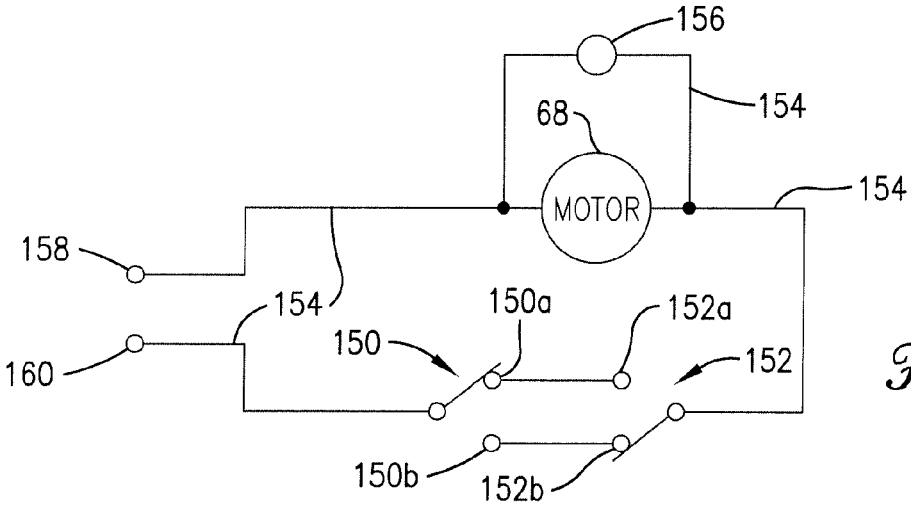
FIG. 9 is a schematic view of a circuit including a switch assembly, a motor, and a lamp of the ball return assembly shown in FIGS. 1-5, showing the circuit in an open condition.

Turning to FIGS. 6-8, the driven wheel 128 is operable to selectively drivingly engage the piston 122 to shift the piston from the forward position to the rearward position. The driven wheel 128 includes a pair of discs 140 that are substantially circular and present a central hole and three spaced apart peripheral holes. The driven wheel 128 further includes bushings 142 received by respective central holes. The discs 140 are attached to one another by disc pins 144 and each of the pins 144 has a cylindrical spacer 146 rotatably mounted thereon. The pins 144 are substantially uniformly spaced in a circumferential direction about an axis of the driven wheel 128, i.e., each pin 144 is angularly spaced from the other pins at an angle of about 120 degrees. While the illustrated driven wheel 128 preferably includes three pins 144, it is also within the ambit of the present invention where fewer than three pins 144 are used or more than three pins 144 are used.

The driven wheel 128 is rotatably mounted on the disc pin 92 by extending the disc pin 92 through the bushings 142 and through the support plates 86. The driven wheel 128 drivingly engages the piston 122 by rotating in a direction shown until one of the pins 144 engages a leading edge of the catch arm 134 in a first angular orientation of the driven wheel 128 (see FIG. 6). Continued rotation of the driven wheel 128 in the direction shifts the piston 122 rearwardly until the piston 122 reaches the rearward position, with the driven wheel 128 being in a second angular orientation (see FIG. 7). Additional rotation of the driven wheel 128 in the direction results in the driven wheel 128 becoming drivingly disengaged from the piston 122, with the driven wheel 128 being in a third angular orientation. The piston 122 is consequently urged by the spring 124 to shift from the rearward position back into the forward position (see FIG. 6). Further rotation of the driven wheel 128 in the direction results in another one of the pins 144 drivingly engaging the catch arm 134, with the driven wheel 128 being in a fourth angular orientation. In this manner, continued rotation of the driven wheel 128 results in successive iterations where the piston 122 is drawn in the rearward direction against the spring 124 and subsequently released to shift in the forward direction.

The drive wheels 126 are operable to drive the driven wheel 128. The drive wheels 126 are unitary rubber wheels that present an annular groove 148. The drive wheels 126 are fixed onto the motor shaft 120, with a spacer positioned therebetween, and thereby rotate with the motor shaft 120. The motor shaft 120 is positioned relative to the driven wheel 128 so that the drive wheels 126 preferably frictionally engage respective ones of the discs 140. However, the wheels 126,128 could drivingly engage one another by an alternative mechanism without departing from the scope of the present invention. For instance, the wheels 126,128 could include respect gear teeth that drivingly mesh with each other, or the wheels 126,128 could be drivingly connected by an endless drive element, e.g., to form a chain-and-sprocket drive or a belt-and-sheave drive. In this manner, the motor 68 is operable to repeatedly draw the piston 122 back into the rearward position and release the piston 122 so that the spring 124 urges the piston 122 out of the rearward position.

While the illustrated linkage assembly 72 is preferred for propelling the ball B, the principles of the present invention are applicable where other mechanisms are used. For example, aspects of the motorized spool arrangement disclosed in the incorporated U.S. Provisional Application No. 60/870,546 could be used to shift the piston 122. Another mechanism for drawing back and releasing the piston 122 involves a threaded rod that extends along the tube axis and is rotated by the motor 68, with a linkage being threadedly engaged with the rod and attached to the piston 122 to draw the piston 122 back. The linkage includes a release mechanism to release the piston 122 and permit the piston 122 to shift forwardly as in the illustrated embodiment.

Turning to FIGS. 5-9, the switch assembly 70 electrically connects the motor 68 to a power source (not shown) to cooperatively form an electrical circuit that selectively powers the ball return assembly 24 in response to the ball B being received and returned by the ball return assembly 24. The switch assembly 70 includes a pair of switches 150,152, electrical leads 154, and an indication lamp 156. The lamp 156 is electrically connected with the motor 68 in parallel. The switches 150,152 are each preferably single pole, double throw mechanical switches that are connected in series with the motor 68. The illustrated switches 150,152 are positioned with switch 150 connected to contact 150*a* and switch 152 connected to contact 152*b*. This is one of two switch configurations where the illustrated circuit is open and prevents the motor 68 from turning. Where the switches 150,152 are connected to contacts 150*a*,152*a* respectively, or to contacts 150*b*,152*b* respectively, the circuit is closed and permits the motor 68 to turn on if a voltage is applied across terminals 158,160. The illustrated circuit is operable to receive power across the terminals 158,160 from a direct current source, such as a battery, or from an alternating current source with circuitry (not shown) to provide a direct current voltage.

The switches 150,152 are secured within the backstop assembly 20 to selectively turn on and off the motor 68 to return the ball B. The switch 150 has a push button (not shown) and switch 152 has a push button 164, with both push buttons being operable to flip the corresponding one of the switches 150,152 between contacts. The push button for the switch 150 includes a large rubber head (not shown). The push button 164 includes a rotatable roller 168. The switch 150 is attached to the bottom wall 56 of trough 30 with the push button extending up through a hole in the trough 30. The push button head is positioned adjacent the opening 62 to be depressed by the ball B as the ball B rolls toward the opening 62. The switch 152 is attached to the support plate 86 with the push button 164 extending through a hole in the support plate 86. The roller 168 is positioned to engage each of the disc pins 144 as they pass by the switch 152 so that the push button 164 is depressed.

The switch assembly 70 turns the motor 68 on and off in response to the ball position. As the ball B leaves the trough 30, the motor 68 is initially off. The ball B engages the push button 164 as it approaches the side opening 62, which causes the switch 150 to move to contact 150*b*, which in turn closes the circuit and turns on the motor 68. The motor 68 begins rotating the driven wheel 128 in the direction so that the piston 122 is shifted toward the rearward position. At the same time, the ball B falls through the duct 74, then through the side opening 106 and into the tube 80. The ball B falls into engagement with the piston 122. As the driven wheel 128 rotates and releases the piston 122, the spring 124 urges the piston 122 and the ball B in the forward direction, with the ball B being propelled out of the forward end 102. As the driven wheel 128 releases the piston 122, one of the pins 144 engages and depresses the push button 164. This causes the switch 152 to contact 152*a*, which in turn opens the circuit and turns off the motor 68. While the illustrated configuration of switches 150,152 is preferable for controlling the ball return assembly 24, the switches 150,152 could be alternatively configured. For instance, the switch 150 could be attached to the duct 74 or the tube 80 to sense when the ball B falls into the tube 80. Furthermore, the switch 152 could be attached to the tube 80 to sense when the ball B has been propelled from the tube 80, or could be attached relative to the linkage frame 78 to sense the longitudinal position of the piston 122. Moreover, other types of switches or sensors could be used to control the ball return assembly 24 without departing from the scope of the present invention.

The illustrated switch assembly 70 is preferably the only structure used to control the ball return assembly 24, but it is also within the ambit of the present invention to use additional controls. For instance, a control could be electrically connected to the switch assembly 70 or motor 68 to permit the user to remotely turn on or off the ball return assembly 24 or to otherwise change how the ball return assembly 24 operates. Also, the backstop assembly 20 is preferably configured to receive and return the single ball B before receiving and returning another ball B. However, it is consistent with the scope of the present invention where the backstop assembly 20 is operable to receive multiple balls before returning any one of the balls.

In operation, a user throws the ball B to the backstop assembly 20, through the opening 50 and into the enclosed volume 52. The ball B falls into the trough cavity and depresses the switch 150 as it passes toward the duct 74. As the ball B passes through the duct 74 and into the tube 80, the switch 150 closes the electrical circuit and turns on the motor 68 and the lamp 156. The motor 68 drives the linkage assembly 72 so that the piston 122 is shifted rearwardly until the driven wheel 128 releases the piston 122 and permits the compressed spring 124 to rapidly shift the piston 122 forward and propel the ball B out of the tube 80 and toward the user. Just after the driven wheel 128 releases the piston 122, the driven wheel 128 depresses the switch 152, with the switch 152 opening the circuit and thereby turning off the motor 68 and lamp 156. In this condition, the backstop assembly 20 is ready to receive and return the ball B again.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A ball returning backstop assembly configured to collect and return a ball thrown by a user, the ball returning backstop assembly comprising:

a backstop configured to collect the thrown ball; and a ball return assembly operably coupled to the backstop to receive the collected ball from the backstop and then return the ball, said ball return assembly including a housing a rotatable motor, and a linkage assembly, said housing presenting a ball guiding surface configured to receive the thrown ball after being collected by the backstop, said ball guiding surface presenting a ball returning path with an axis that extends from a rearward end of the path to a forward end of the path, with the surface being configured to guide the ball along the axis as the ball is being propelled toward the forward end, said linkage assembly drivingly coupled to the motor and including a link shiftably mounted relative to the housing, said link being shiftable to reciprocate between a rear position adjacent the rearward end and a forward position spaced forwardly of the rear position, said link having a ball-engaging end that is operably coupled to the housing to follow the axis, with the ball-engaging end being configured to engage the ball and propel the ball along the axis, said housing presenting between the path ends an opening that communicates the ball returning path with the backstop, with the linkage assembly being configured to position the ball received from the backstop through the opening forwardly of the ball-engaging end, said linkage assembly including a return spring that biases the link toward the forward end, said spring exerting a spring force when the link is in the rearward position, with any force exerted by the spring being less than the spring force when the link is in the forward position, said linkage assembly including a second link drivingly attached relative to the motor to be spun by the motor in a direction, said links being drivingly engaged so that rotation of the second link in the direction from a first angular orientation to a second angular orientation shifts the first-mentioned link from the forward position to the rearward position, said links being drivingly disengaged by rotation of the second link in the direction from the second angular orientation to a third angular orientation, with the first-mentioned link being biased by the return spring back into the forward position, said links being drivingly re-engaged by rotation of the second link in the direction from the third angular orientation to a fourth angular orientation, with the first-mentioned link being shifted from the forward position to the rearward position.

2. The ball returning backstop assembly as claimed in claim 1, said opening spaced in front of the forward position of the link, said surface being operable to receive the ball while the ball-engaging end is at any location between the positions.

3. The ball returning backstop assembly as claimed in claim 1, said path being inclined so that the rearward end is spaced below the forward end, with the ball thereby being encouraged to fall toward the rearward end and into engagement with the ball-engaging end prior to being propelled.

4. The ball returning backstop assembly as claimed in claim 1, said ball return assembly including a switch assembly with an engaged condition and a disengaged condition, said switch assembly being coupled to the motor and configured to turn the motor on when engaged and off when disengaged, said switch assembly including a switch attached relative to the housing and operable to be engaged by the ball after the ball is collected by the backstop, with the switch assembly thereby becoming engaged.

5. The ball returning backstop assembly as claimed in claim 4, said switch assembly including another switch, said switches both being mechanical double throw switches and connected to one another in series, with both of the switches being operable to place the switch assembly in one of the conditions, said another switch being attached relative to the housing and operably connected to the linkage assembly, with the another switch being engaged as the link shifts into the forward position and thereby operable to disengage the switch assembly following the first-mentioned switch engaging the switch assembly.

6. The ball returning backstop assembly as claimed in claim 5, said backstop including a ball-collecting trough, said first-mentioned switch being attached to the ball-collecting trough and configured to be engaged by the ball as the ball leaves the trough to enter the path.

7. The ball returning backstop assembly as claimed in claim 5, said ball returning assembly including a frame, with the second link being rotatably mounted on the frame, said another switch being attached to the frame and operable to be engaged by the second link.

8. The ball returning backstop assembly as claimed in claim 1, said second link being rotated through an angle of about 120 degrees when shifted from the second angular orientation to the fourth angular orientation.

9. The ball returning backstop assembly as claimed in claim 1, said first-mentioned link including a catch end opposite the ball-engaging end, said second link being rotatably mounted relative to the housing and including a link-engaging element, said link-engaging element drivingly engaging the catch end from the first angular orientation to the second angular orientation.

10. The ball returning backstop assembly as claimed in claim 9, said second link having a second link-engaging element spaced from the first-mentioned element, said second link-engaging element drivingly engaging the catch end in the fourth angular orientation.

11. The ball returning backstop assembly as claimed in claim 1, said second link including a disc that presents a disc perimeter, said linkage assembly including a rotatable wheel that is drivingly connected to the motor, said rotatable wheel being in frictional engagement with the disc along the disc perimeter to thereby drivingly interconnect the motor and second link.

12. The ball returning backstop assembly as claimed in claim 1, said housing including a substantially cylindrical tube that presents the ball guiding surface, with the axis being substantially linear.

13. The ball returning backstop assembly as claimed in claim 12, said housing including a base that is pivotally attached relative to the tube, said tube operable to be pivotally fixed relative to the base at a predetermined ball return angle.

14. The ball returning backstop assembly as claimed in claim 13, said ball return angle being in the range from about zero degrees to about thirty degrees.

15. The ball returning backstop assembly as claimed in claim 14, said ball return angle being about twenty-five degrees.

16. The ball returning backstop assembly as claimed in claim 12, said first-mentioned link including a piston slidably mounted within the tube, with the first-mentioned link substantially only translating between the positions.

17. The ball returning backstop assembly as claimed in claim 12, said backstop including a ball-collecting trough, said ball return assembly including a duct connected to the tube and communicating with the opening, said duct being connected to the ball-collecting trough with the collected ball being permitted to pass from the trough to the opening by passing through the duct.

* * * * *